US005126518A

United States Patent [19]

Beckett

[11] Patent Number: 5,126,518

[45] Date of Patent: Jun. 30, 1992

[54] MICROWAVE COOKING CONTAINER COVER

[75] Inventor: D. Gregory Beckett, Oakville, Canada

[73] Assignee: Beckett Industries Inc., Oakville, Canada

[21] Appl. No.: 673,515

[22] Filed: Mar. 22, 1991

Related U.S. Application Data

[63] Continuation-in-part of Ser. No. 585,289, Sep. 19, 1990, abandoned, which is a continuation of Ser. No. 442,166, Nov. 28, 1989, abandoned.

[51] Int. Cl.[5] ..... H05B 6/80

[52] U.S. Cl. ..... 219/10.55 E; 219/10.55 F; 426/107; 426/234; 99/DIG. 14

[58] Field of Search ..... 219/10.55 E, 10.55 F, 219/10.55 D; 426/107, 109, 113, 114, 234, 241, 243; 126/390; 99/DIG. 14

[56] References Cited

U.S. PATENT DOCUMENTS

| | | | |
|---|---|---|---|
| 3,079,913 | 3/1963 | Nelson | 126/390 |
| 3,219,460 | 11/1965 | Brown | 219/10.55 E |
| 3,302,632 | 2/1967 | Fichtner | 219/10.55 F |
| 3,398,041 | 8/1968 | Ferree | 161/113 |
| 3,615,713 | 10/1971 | Stevenson et al. | 219/10.55 |
| 3,672,916 | 6/1972 | Virnig | 99/171 H |
| 3,799,143 | 3/1974 | Bridges | 126/246 |
| 3,941,967 | 3/1976 | Sumi et al. | 219/10.55 E |
| 4,013,798 | 3/1977 | Goltsos | 426/107 |
| 4,190,757 | 2/1980 | Turpin et al. | 219/10.55 E |
| 4,230,924 | 10/1980 | Brastad et al. | 219/10.55 E |
| 4,398,994 | 8/1983 | Beckett | 156/659.1 |
| 4,495,392 | 1/1985 | Derby | 219/10.55 E |
| 4,552,614 | 11/1985 | Beckett | 156/659 |
| 4,555,605 | 11/1985 | Brown et al. | 219/10.55 E |
| 4,610,755 | 9/1986 | Beckett | 156/634 |
| 4,626,641 | 12/1986 | Brown | 219/10.55 E |
| 4,676,857 | 6/1987 | Scharr et al. | 156/233 |
| 4,703,148 | 10/1987 | Mikulski et al. | 219/10.55 E |
| 4,703,149 | 10/1987 | Sugisawa et al. | 219/10.55 E |
| 4,735,513 | 4/1988 | Watkins et al. | 383/116 |
| 4,888,459 | 12/1989 | Keefer | 219/10.55 E |

*Primary Examiner*—Philip H. Leung
*Attorney, Agent, or Firm*—Sim & McBurney

[57] ABSTRACT

A lid for a T.V. dinner tray is constructed to provide a more uniform heating of frozen prepared foodstuffs by controlling the flow of microwave radiation to the foodstuff, to effect a decreased flow of microwave energy to the foodstuffs in certain zones of the tray and an enhanced flow of microwave energy to the foodstuffs in the remainder of the tray. The lid comprises a polymeric material layer and a patterned layer of continuous microwave-reflective material adhered thereto.

6 Claims, 1 Drawing Sheet

MICROWAVE COOKING CONTAINER COVER

REFERENCE TO RELATED APPLICATION

This application is a continuation-in-part of my copending U.S. patent application Ser. No. 585,289, filed Sep. 19, 1990 (now abandoned) which itself is a continuation of U.S. patent application Ser. No. 442,166 filed Nov. 28, 1989 (now abandoned).

FIELD OF INVENTION

This application relates to a novel cover for a container for a foodstuff, for example, a T.V. dinner tray which is provided with a novel lid arrangement which enables more uniform microwave heating of foodstuffs in compartments of the tray to be achieved.

BACKGROUND TO THE INVENTION

In T.V. dinners, a complete prepared dinner is packaged in separate compartments in a tray. Typically, separate compartments are provided for meat, potato, vegetables and desert. The foodstuffs are prepared for serving and frozen for reconstitution for consumption. A problem which has been encountered with such products is uneven heating of the foodstuffs in the compartments upon reconstitution for consumption by microwave energy, since they often cook at different rates when exposed to microwave energy. This lack of uniformity of heating is often considered undesirable by the consumer.

Various attempts have been made to improve the uniformity of heating of the foodstuffs in the compartments by the application of microwave energy thereto. In this regard, a search of the records of the U.S. Patent and Trademark Office has revealed the following U.S. Patents as the closest prior art:

| | |
|---|---|
| 3,079,913; | 3,219,460; |
| 3,240,610; | 3,271,169; |
| 3,398,041; | 3,615,713; |
| 3,672,916; | 3,799,143; |
| 4,013,798; | 4,555,605; |
| 4,626,641; | 4,656,325; |
| 4,703,148; | 4,676,857; and |
| 4,703,149 | |

In addition, the Examiner has cited the following addition prior art in the grand-parent application:

| | | |
|---|---|---|
| U.S. Pat. No. | 4,656,325; | 4,735,513; |
| | 4,190,757; | 4,676,857 |
| | 3,219,460; | 3,941,967; and |
| | 4,495,392 | |

These prior art references describe a variety of microwave energy shielding and focussing devices for the purposes of redistribution of microwave energy to the prepared foodstuffs in the T.V. dinner tray.

One proposal for dealing with the problem of uneven heating is described in the aforementioned U.S. Pat. No. 4,656,325. In this patent, there is described the provision of a lid structure having a plurality of metal islands and which is arranged to be spaced from the foodstuff in the holding pan so as to permit microwave energy to pass through the cover onto the package without interfering with internal reflections of the microwave energy within the package by the metal islands.

This prior art structure is expensive to manufacture and cumbersome to employ. Others of the prior art structures simply are not effective to produce the desired result.

SUMMARY OF INVENTION

The present invention provides a relatively simple structure, different from the prior art, which, nevertheless, is able to achieve the desired more uniform degree of heating upon application of microwave energy to a multicompartment T.V. dinner tray or other container containing prepared foodstuffs for cooking for consumption.

On examining a reconstituted T.V. dinner upon conventional microwave heating, it has been observed that, when aiming for a desired meat temperature, vegetables heat the most and potato the least and there is often a considerable differential in temperature between the top and bottom of the foodstuff contained in the tray.

In accordance with the present invention, it has surprisingly been found that, by providing a microwave energy reflector of specific structure over those regions tending to heat more, a much more uniform degree of heating to the different foodstuffs is possible, together with an enhanced degree of uniformity of temperature between the top and the bottom of the foodstuff in the individual compartments.

For a multicompartment T.V. dinner tray containing a meat course, vegetable, desert and potato, the microwave energy reflector is placed over the vegetable and desert compartments. This positioning has the effect of shielding microwave energy from those compartments and diverting it into the other compartments.

In accordance with the present invention, there is provided a cover with a container having at least one compartment for prepared foodstuffs for reconstitution by microwave energy, which comprises a continuous polymeric material layer having at least the dimensions of the cover and a pattern on one surface of the polymeric material layer comprising a continuous layer of microwave-reflective material which inhibits the flow of microwave energy through the cover in the region of the pattern and enhances the flow of microwave energy through the lid in the remainder of the cover. In this way, the degree to which prepared a foodstuff is subject to microwave energy is controlled when the container as a whole is exposed to microwave energy.

In its broadest aspect, the cover of the present invention comprises two elements, namely a polymeric material layer having at least the dimensions of the cover and a continuous layer of microwave-reflective material supported in a pattern on the polymeric film layer. For convenience, the polymeric film layer usually is laminated to a layer of paper or paperboard of the same dimensions as the polymeric film to impart structural strength and rigidity to the polymeric film layer, when the latter is formed of flexible polymeric material.

GENERAL DESCRIPTION OF INVENTION

Figure 1:
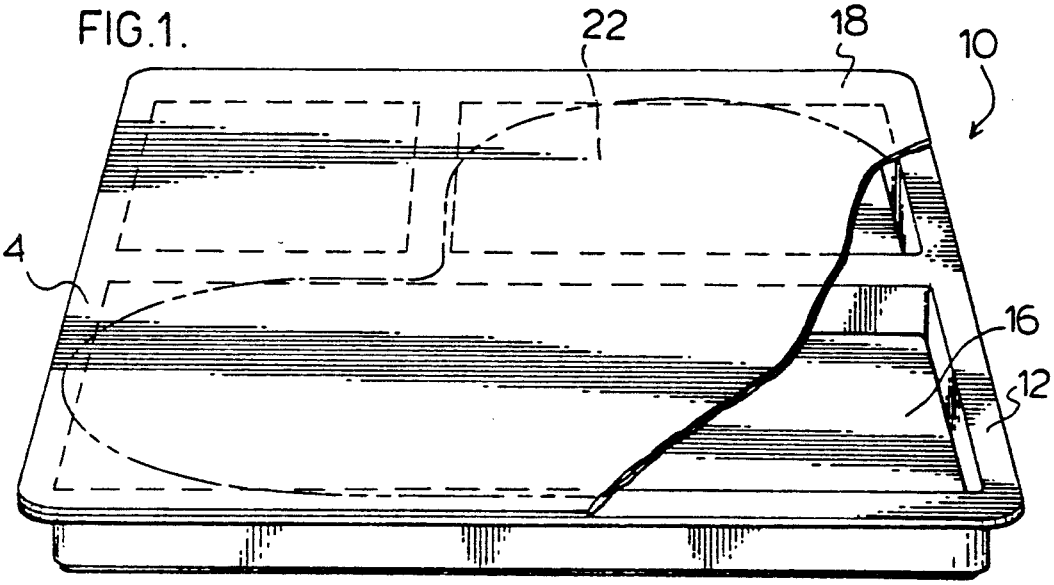
FIG. 1 is a perspective view of a cover structure provided in accordance with one embodiment of the invention and assembled with a TV dinner tray.
Figure 2:
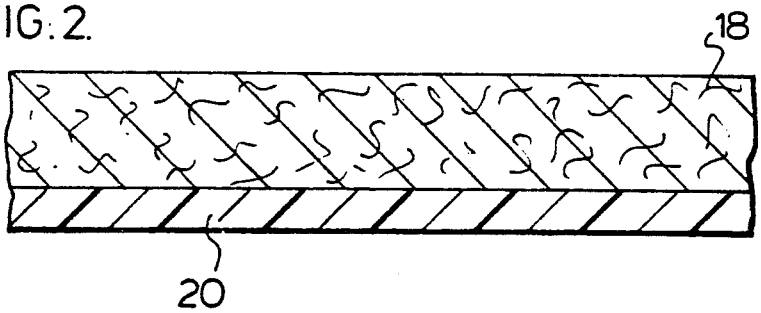
FIGS. 2 and 3 are sectional views of the cover structure.
Figure 3:
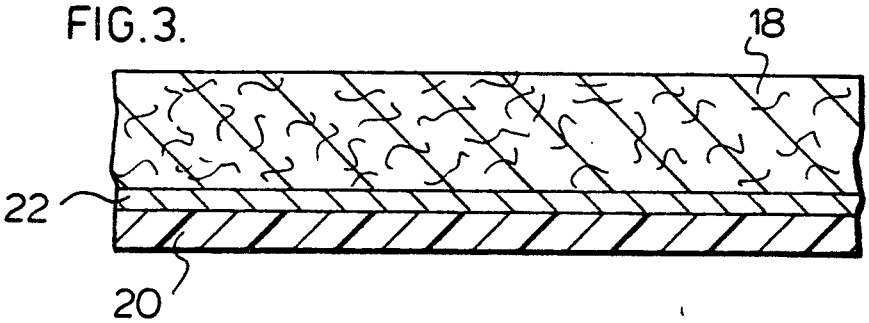

The microwave energy reflector may be provided of any convenient material, generally an electroconductive material, such as a metal, for example, aluminum. The reflector may vary in thickness from one at which the metal is partially reflective and partially transmissive of microwave energy to a thickness at which the metal is wholly reflective of incident microwave energy.

The thickness required to provide the required microwave reflective effect depends on the metal chosen. For the preferred metal, namely aluminum, a thickness ranging from that corresponding to an optical density of about 0.70 up to foil-thickness, namely about 1 to about 15 microns, preferably about 3 to about 10 microns, typically about 7 to 8 microns, can be employed. It has further been found that a thickness down to that corresponding to an optical density of about 0.2 can be employed and still have the required effect of diverting or channelling the microwave energy into the non-covered areas, so as to enhance the heating effect therein, although some microwave transmission also occurs at that thickness level, enabling a controlled degree of microwave heating of the foodstuff by the transmitted microwave energy to be achieved.

The microwave energy reflective layer is provided as a continuous layer but in a pattern which is determined by the effect desired, supported on a substrate of polymeric material which is at least coextensive with the dimensions of the cover. The polymeric material substrate may be rigid or flexible.

Most conveniently, the microwave energy reflective material is an etchable metallic layer supported on a flexible polymeric material substrate, which permits the desired pattern of microwave-reflective material to be formed by selective demetallization, employing, for example, one of the procedures described in U.S. Pat. Nos. 4,398,994, 4,552,614 and 4,610,755, the disclosures of which are incorporated herein by reference.

The etchable metallic layer may be etched to the desired pattern prior to adhesion to the polymeric material layer. However, it usually is preferred to have the etchable metal layer adhered to the polymeric material layer, either by lamination or by vapor deposition, prior to etching.

The two-element structure of the continuous patterned microwave-reflective metal layer on the continuous polymeric material layer may be employed alone, particularly if the polymeric material is rigid, or may be laminated or otherwise bonded to one or more layers of paperboard, particularly in the case of a flexible polymeric material substrate, generally of the same dimension as the polymeric film layer, to provide a relatively rigid structure. When paperboard or other microwave-transparent dielectric support material is used, the paperboard usually is laminated to the metal layer side of the structure.

The container cover may be provided as a separate element or may be provided joined at one side to a lower tray to provide a hinged container structure.

The present invention may also be employed in combination with a structure such as described in U.S. Pat. No. 4,230,924, the disclosure of which is incorporated herein by reference. As described therein, a pattern of islands of metal foil may be provided on a dielectric substrate. When such an arrangement is employed with a T.V. dinner tray or similar container, with a part being left clear an enhanced heating effect with respect to the foodstuff is achieved in the zone covered by the island structure, as compared with the clear area.

When this experiment is repeated with a continuous solid foil replacing the island patterned foil, then an enhanced heating is observed in the clear area, but not as great as the patterned area in the previous experiment.

With the combination of the continuous solid foil and island patterned foil, a greater enhanced heating effect is observed in the island patterned foil area than is observed in the first experiment, while a greater shielding effect is observed in the continuous solid foil area than in the second experiment.

These effects may be used in a T.V. dinner tray to achieve degrees of enhanced heating and shielding, as desired, by appropriate manipulations of clear polymeric film layer, continuous foil and patterned foil supported on a polymeric film layer.

In one embodiment, the substrate polymeric film layer is completely covered with the continuous microwave-reflective metal layer, except for regions of the surface thereof corresponding to the meat compartment and the potato compartment, from which the metal layer is absent. This arrangement effects, not only reflection of microwave energy in the region of the continuous metal layer, but, for certain patterns, also effects focussing of the microwave energy into certain of the regions from which the metal is absent, thereby enhancing the heating in such regions and contributing to the uniformity of heating achieved.

Another application of the principles of the invention is with respect to foodstuffs packaged in plastic containers, generally of box-like construction ("Tupperware"), or a variety of paperboard containers, for example, pizza boxes, to achieve desired shielding and enhanced heating effects.

When microwave heating such products as, for example, lasagna and pizza, uneven heating occurs. Typically, while outside portions may be satisfactorily heated, inner portions are not. In accordance with the invention, microwave reflective material is employed on the walls of the container as well as its cover and possibly the bottom of the container, with a circular opening being provided at approximately the central portion of the reflective material on each wall. By providing the container with the layers of microwave reflective material, enhanced uniformity of heating of the food product is obtained.

The present invention, therefore, provides a cover structure for T.V. dinners or other microwaveable foodstuffs which does not require the spacing from the food of U.S. Pat. No. 4,656,325, but rather is employed as a conventional planar cover for the tray containing the foodstuff, but is able to achieve satisfactory microwave reconstitution of frozen T.V. dinners and provide even heating in all food compartments in a single rapid microwave cooking operation, which does not require any interruptive intermediate procedures, such as changing the cooking power and/or rotating the dinner tray during cooking.

As noted earlier, the principles of the invention may be applied to the microwave heating of a variety of food products where it is desired to provide a greater intensity of heating of the food product or a combination of several different food products in one region thereof from another, in order to achieve a microwave-heated food product having a uniform temperature.

DESCRIPTION OF PREFERRED EMBODIMENT

Referring to the drawings, a TV dinner tray structure 10 comprises a tray 12 and a lid 14. The tray is divided into several compartments 16, as is conventionally the case. which are intended to receive different components of the meal.

The lid 14 comprises an upper paperboard layer 18 and a lower polymeric film lay 20, both of which are coextensive with the lid 14. Sandwiched between the upper paperboard layer 18 and a lower polymeric film layer 20 is a continuous layer of aluminum foil 22.

Although provided as a continuous layer, the aluminum foil layer 22 is provided in a pattern which extends only over certain ones of the compartments 16, to shield the respective compartments 16 from the full effect of incident microwave energy, and hence slow down cooking of the foodstuff in the compartments 16 so shielded.

Referring to the drawings, a semi-rigid T.V. dinner tray lid 10 comprises an upper paperboard layer 12, a lower polymeric film layer 14 coextensive with the paperboard layer 12 and an aluminum foil layer 16 sandwiched between the upper and lower layers 12 and 14 and formed in a pattern, as seen in FIG. 1.

EXAMPLE

Commercial frozen Swanson-brand Salisbury steak dinners were cooked by the application of microwave energy for 10 minutes at half power (the cooking instructions provided with the T.V. dinner) in a 450 watt 0.5 cu ft. Sanyo-brand microwave oven without and with a cover according to the invention and as illustrated in the drawings. The patterned metal layer 16 was arranged to cover the vegetable and desert compartments.

The heating effect obtained was compared to that obtained with a conventional cover for the same product. The results obtained are set forth in the following Table I:

TABLE I

| | Compartment Temp. | | | | |
|---|---|---|---|---|---|
| | Veg. (corn) | Desert | Potato | Steak | Spread |
| Inventive | | | | | |
| cover-top | 60 | 70 | 65 | 60 | 12 |
| -bottom | 63 | 71 | 72 | 60 | 12 |
| Prior Art (No Lid) | | | | | |
| -top | 80 | 73 | 32 | 65 | 48 |
| -bottom | 72 | 72 | 18 | 60 | 54 |

As may be seen from the results set forth in the above Table I, by employing the cover structure of the invention, very even heating of the contents of the T.V. dinner tray is achieved, in contrast to the prior art.

SUMMARY OF DISCLOSURE

In summary of this disclosure, the present invention provides, in particular, a novel T.V. dinner tray cover comprising a continuous polymeric material layer supporting a patterned continuous layer of microwave-reflective material, which enables uniform heating of the different types of the food in the multi-compartment tray to be achieved, and, in general, a means of effecting differential intensities of microwave heating to different portions of food products. Modifications are possible within the scope of this invention.

I claim:

1. A cover for a container having at least one compartment for prepared foodstuff for reconstitution for consumption by microwave energy, which consists essentially of:

a planar continuous polymeric material layer, a microwave-reflective pattern supported on and in adhered relation with one surface of said polymeric material layer comprising a continuous layer of microwave reflective material within a periphery thereof, said microwave reflecting material inhibiting the flow of a microwave energy through the cover within the periphery of and in the location of said pattern on said polymeric material layer and enhancing the flow of microwave energy through said cover outside the periphery of said pattern and in the region of said polymeric material layer from which said continuous layer of microwave reflective material is absent whereby there is controlled the degree to which prepared foodstuff positioned in the at least one compartment is subjected to microwave energy through said cover when the container is exposed to microwave energy, and a layer of paperboard material coextensive in dimension with said flexible polymeric material layer and adhered to said polymeric material layer outside said periphery of said pattern and to said pattern within said periphery, so as to sandwich said layer of microwave-reflective material between said polymeric film layer and said paperboard material layer.

2. The cover of claim 1 wherein said polymeric material layer is rigid.

3. The cover of claim 2 wherein said polymeric material layer is flexible.

4. The cover of claim 1 wherein said layer of microwave-reflective material is a layer of aluminum foil having a thickness of about 1 to about 15 microns.

5. The cover of claim 4 wherein said aluminum foil has a thickness of about 3 to about 10 microns.

6. The cover of claim 1 wherein said layer of microwave reflective material has an approximately kidney-shaped outline.

* * * * *